US008066078B2

(12) United States Patent
Braddick

(10) Patent No.: US 8,066,078 B2
(45) Date of Patent: Nov. 29, 2011

(54) OVERSHOT TOOL AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 179 days.

(21) Appl. No.: 12/536,561

(22) Filed: Aug. 6, 2009

(65) Prior Publication Data

US 2011/0030971 A1 Feb. 10, 2011

(51) Int. Cl.
*E21B 19/16* (2006.01)

(52) U.S. Cl. ..... 166/380; 166/98; 166/301

(58) Field of Classification Search ..... 166/98, 166/301, 380; 294/86.15, 86.17, 86.24, 86.25, 294/86.3, 86.33
See application file for complete search history.

(56) References Cited

U.S. PATENT DOCUMENTS 4,023,847 A 5/1977 Webb
4,127,297 A 11/1978 Dufrene
5,054,833 A 10/1991 Bishop et al.
5,690,170 A 11/1997 Hailey et al.
6,425,615 B1 7/2002 Mullane, Jr.
7,278,492 B2 * 10/2007 Braddick ..... 166/382
7,422,068 B2 9/2008 Lynde
7,493,946 B2 2/2009 Filippov et al.
7,503,388 B2 3/2009 Fay et al.
2008/0053656 A1 * 3/2008 Lynde ..... 166/277

* cited by examiner

*Primary Examiner* — William P Neuder
*Assistant Examiner* — Richard Alker
(74) *Attorney, Agent, or Firm* — Browning Bushman P.C.

(57) ABSTRACT

An overshot tool is provided for interconnecting and sealing between a lower tubular (C) in a well and an upper tubular (30). A tubular expander sleeve (36) and an overshot sleeve (26) are supported in a well on an upper tubular. The tool housing (60) encloses a plurality of axially stacked pistons (58, 68, 74), which generate an axial force to move the expander sleeve downward and radially expand a portion of a lower tubular to seal between an outer diameter of the lower tubular and an inner diameter of the overshot sleeve.

20 Claims, 3 Drawing Sheets

OVERSHOT TOOL AND METHOD

FIELD OF THE INVENTION

The present invention relates to an overshot tool of the type used for interconnecting a lower tubular and an upper tubular in a well. More particularly, the invention relates to an overshot tool with a tubular expander sleeve which moves in response to fluid pressure applied to stacked pistons to force the expander sleeve downward and radially expand the lower tubular to connect with an upper tubular.

BACKGROUND OF THE INVENTION

Various types of overshot tools have been designed for interconnecting and sealing between a lower tubular in a well and an upper tubular in a well. In an exemplary application, the lower tubular may have separated or may have been cut off so that the overshot tool connects an upper end of the lower tubular with a lower end of the upper tubular each positioned within the well.

U.S. Pat. Nos. 4,023,847, and 4,127,297, disclose overshot tools developed in the 1970's. U.S. Pat. No. 5,054,833, discloses a releasable overshot which is complex and has numerous parts. An overshot cutter is disclosed in U.S. Pat. No. 5,690,170. U.S. Pat. No. 6,425,615, discloses an overshot tool with a radially expandable and contractable grapple. U.S. Pat. No. 7,422,068, discloses a casing patch overshot which utilizes a wedge to expand a lower end of an upper tubular. U.S. Pat. No. 7,493,946, discloses a tool for radially expanding a tubular. U.S. Pat. No. 7,503,388, discloses an overshot retrieval tool with a slip-type overshot.

One of the primary difficulties associated with overshot tool techniques is the reliability of the mechanical interconnection and the fluid tight seal between the upper end of the lower tubular and the lower end of the upper tubular. In some applications, the mechanical connection may be adequate for a short time, but subsequently problems may exist when the lower tubular begins to separate from the upper tubular. In other applications, a mechanical interconnection is maintained, but the fluid tight seal is lost between the upper and lower tubulars, so that some fluid from the lower tubular escapes to the annulus surrounding the lower and upper tubulars, or fluid from the annulus enters the tubular at the overshot interconnection.

The disadvantages of the prior art are overcome by the present invention, and an improved overshot tool and method of interconnecting and sealing between a lower tubular and an upper tubular are hereinafter disclosed.

SUMMARY OF THE INVENTION

In one embodiment, an overshot tool includes a tubular expander sleeve and an overshot sleeve each supported in the well on an upper tubular. A plurality of sealing members may be positioned on a radially inward surface of the overshot sleeve, and the overshot sleeve is positioned radially outward of the lower tubular. A tool housing is positioned in the well on a work string, and encloses a plurality of axially movable stacked pistons for generating a cumulative axial force. An anchor engages an inner surface of the lower tubular and axially fixes the position of the tool housing in the well. The anchor is movable to a set position in response to axial movement of the plurality of pistons, which movement also moves the tool housing relative to the tool mandrel to push the expander sleeve downward and radially expand a portion of a lower tubular and thereby secure the lower tubular and the overshot sleeve.

According to the method of the invention, a tubular expander and overshot sleeve are supported on the upper tubular, while the tool housing is supported in the well on a work string and encloses a plurality of axially movable stacked pistons. An anchor engages a lower tubular to position the tool housing in the well. The plurality of pistons are energized to push the expander sleeve axially downward to radially expand a portion of the lower tubular, such that the overshot sleeve is connected with the expanded lower tubular.

These and further features and advantages of the present invention will become apparent from the following detailed description, wherein reference is made to the figures in the accompanying drawings.

DETAILED DESCRIPTION OF PREFERRED EMBODIMENTS

Figure 1:
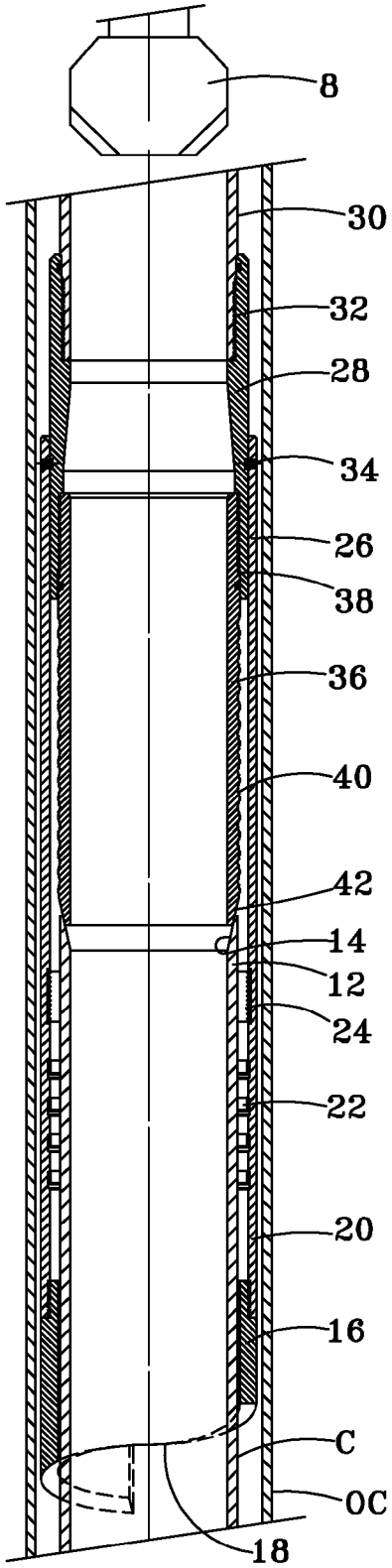
FIG. 1 is a cross-sectional view of the tubular expander positioned in the well on an upper tubular, with a lower end of the expander engaging an upper end of the lower tubular.

In an exemplary application for the overshot tool, the casing C as shown in FIG. 1 exists in a well, but has separated for one of various reasons. The overshot tool may be used for interconnecting that lower tubular with an upper tubular which extends upward toward the surface of the well. To begin the process to form the overshot connection, a conventional cutter bit 8 as shown in FIG. 1 may be lowered to engage the upper end of lower tubular C (the upper tubular 30, the connector 28, the expander sleeve 36, and the overshot sleeve 26 are not in the well at this stage). The rotating cutter assembly 8 may thus dress the upper end 12 of the lower tubular C to form a conical surface 14, with the apex of the conical surface being below the surface 14. Once the lower tubular C is dressed at its upper end, the cutter may be removed from the well, so that only the dressed casing C and the outer casing OC are left in the well.

Upper tubular 30, which may be the same size as the lower tubular C, may then be lowered in the well. Connector 28 is threaded at 32 to a lower end of the upper tubular, and expander sleeve 36 with radially outward bumps 40 is threaded at 38 to the lower end of the connector 28. The lower end of the expander sleeve includes a conical surface 42 which may be similarly tapered for subsequent sliding engagement with the conical surface 14 at the upper end of the tubular C. The upper end of the overshot sleeve 26 is pinned at 34 to the connector 28, and extends downward to circumferentially surround the lower tubular C. The lower end of the overshot sleeve 26 has a lip guide 16 with a contoured lower surface 18 for sliding engagement with the outer diameter of the tubular C. A plurality of circumferential packing members 22 are positioned along an internal surface 20 of the sleeve 26 and slide with the sleeve 26 over the tubular C. FIG. 1 also illustrates a plurality of circumferential slips 24 mounted on the interior surface 20 of the overshot sleeve 26. The slips 24 are preferably positioned above the packing members 22, and as explained subsequently provide a secured mechanical engagement of the expanded tubular C with the overshot sleeve 26.

Figure 2:
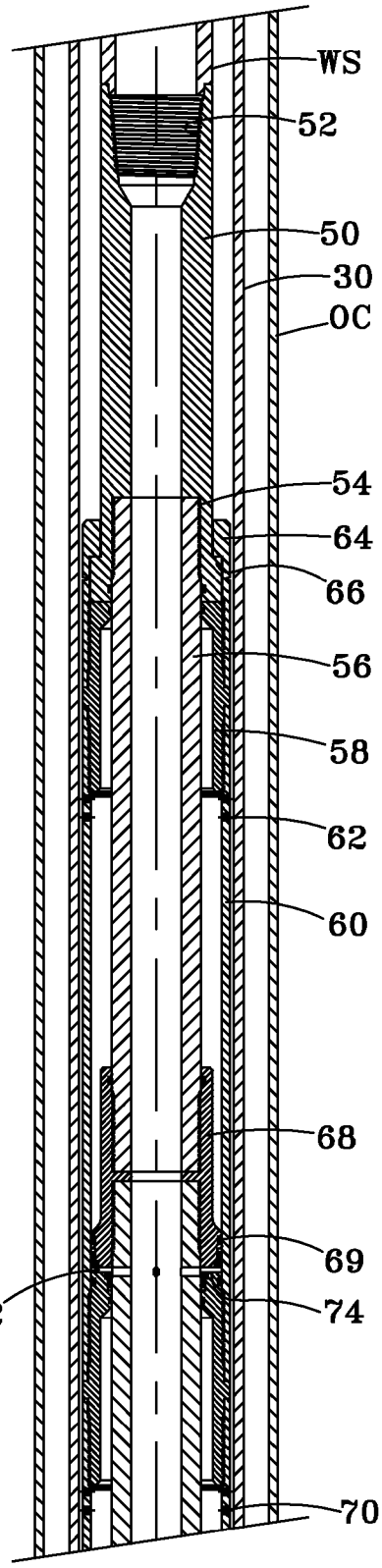
FIG. 2 is a cross-sectional view of a portion of the hydraulic power section of the tool positioned in the well on a work string.

Once the components are positioned as shown in FIG. 1, an overshot tool as shown partially in FIG. 2 may be lowered in the well on a work string WS, with the lower end of the work string threaded to 52 and thus connecting the work string to the mandrel body 50. The lower end of mandrel body 50 is threaded at 54 to mandrel 56. Outer tubular housing 60 surrounds the mandrel 56 with a shear ring 64 having an L-shaped cross-sectional configuration engaging shoulder 66 on the mandrel body 50. An outer piston 58 is sealed to the outer surface of the mandrel 56, and is threadably connected to the housing 60. A plurality of vent holes 62 are provided for allowing fluid to escape from a reducing volume annulus between the housing 60 and the mandrel 56 when the hydraulic tool is activated. FIG. 2 also depicts an inner piston 68 having a seal 69 for sealing with the inner surface of housing 60, with the inner piston being threadably connected to the mandrel 56. FIG. 2 also depicts another outer piston 74 threadably connected to the housing 60 and sealed to the mandrel. Additional vent holes 70 may be provided in the outer housing. Mandrel 56 also contains ports 72 so that hydraulic fluid may pass through the ports and thereby energize both the inner and outer pistons. Those skilled in the art will appreciate that only a few of the inner and outer pistons are shown in FIG. 2, but that a relatively large number of stacked inner and outer pistons are preferably provided for exerting a combined axial force to perform the operations discussed below.

Figure 3:
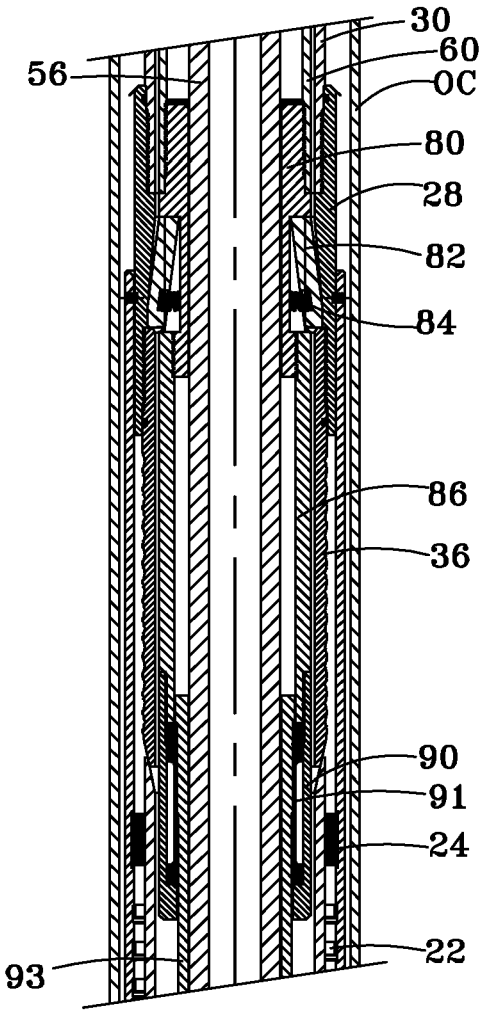
FIG. 3 is a cross-sectional view of a portion of the tool which engages the tubular expander.

FIG. 3 depicts the tool suspended in the well from the work string and landed on the top of sleeve 36, as shown in FIG. 1. A lower end of the outer housing 60 is threadably connected to lock housing 80 which surrounds the mandrel 56. The housing 80 supports a plurality of dogs 82, each of which are biased radially outward by a respective biasing spring 84, but may only be compressed radially inward for tool retrieval. When the dogs are positioned outward as shown in FIG. 3, the dogs engage the top of sleeve 36 so that sleeve 36 provides a base for the landed assembly. Tubular extension 86 extends downward from housing 80, and supports collet assembly 90 including collets 91 which fit within annular grooves in the telescopic joint 93. Collet assembly 90 provides for proper setting of the slips discussed below. Mandrel upper body 56 extends through the collet assembly 90 and through the slip actuator 98. A slip cage upper body 94 is threaded to the lower end of expansion joint 93. Slips are positioned in pockets in the slip cage, which has a lower body 100. Slip actuator body 98 is shown with camming surfaces for forcing the slips 96 radially outward to grip the tubular, and is threaded and supported at 102 to body 104, which is threaded to mandrel 56 and supports ball seat 106 thereon. Port 108 in the ball seat 106 fluidly connects with annular groove 105 in body 104 after setting the overshot and shearing pins 110 when the seat 106 lands on support surface 114. This allows fluid from within the mandrel 56 to drain around the ball into ports 108 and through the bottom of body 104 when the tool is pulled to the surface.

Figure 4:
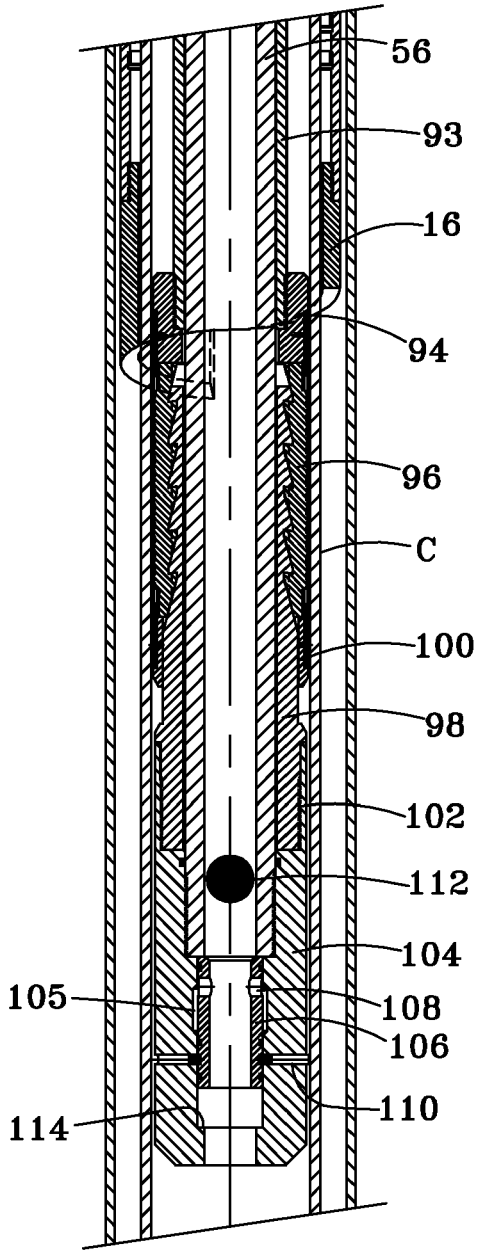
FIG. 4 is a cross-sectional view of an anchor securing the tool to the lower tubular.

To activate the tool, the ball 112 may be dropped to land on the seat 106 as shown in FIG. 4. This will permit increase of fluid pressure within the mandrel, thereby increasing pressure to activate the pistons 58, 68, 74. When the pistons are activated, the mandrel 56 initially moves upward to set slips 96 and fix the position of the tool in the well relative to the lower tubular. Axial movement of the pistons will thus initially move the mandrel 56 up relative to the housing 80. Once the slips are set, continued energization of the pistons will force the housing 60 and thus lock housing 80, dogs 82, and expansion sleeve 36 axially downward relative to the mandrel 56, thereby radially expanding the lower tubular C while compressing the packing rings 22 and retaining secured engagement between the lower tubular and the overshot sleeve via the compressed slips 24.

Figure 5:
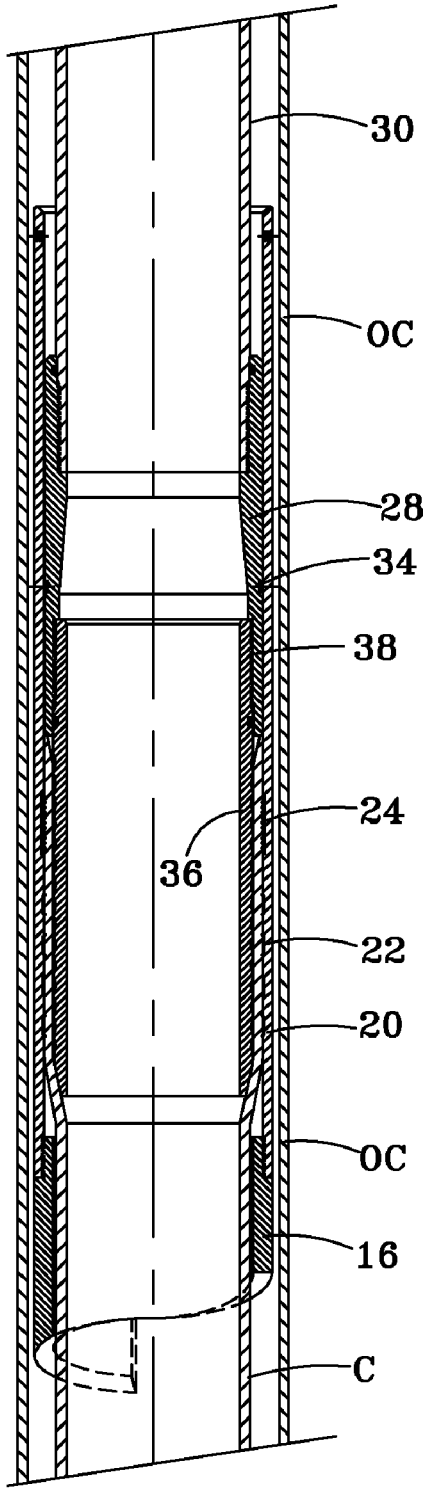
FIG. 5 illustrates the expander sleeve pushed downward to expand a portion of a lower tubular, thereby structurally and fluidly interconnecting the lower tubular and the upper tubular, with the remaining portions of the tool removed from the well.

During retrieval of the tool, an upward force exerted on the mandrel will pull the dogs 82 upward out of engagement with the expander sleeve 36, thereby compressing the springs as the dogs move radially inward. Substantially the entirety of the tool is thus retrieved from the well, with only the components as shown in FIG. 5 remaining in the well. The tool provides secured mechanical and fluid tight engagement of the lower tubular C with the upper tubular 30 due to tubular expansion of the lower tubular. Also, it may be understood that the inner diameter of the sleeve 36 approximates the inner diameter of the tubular C and also the inner diameter of the upper tubular 30, so that essentially a "full bore" connection is achieved.

The embodiment discussed above includes an overshot sleeve 26 which and contains both circumferential packing members 22 and slips 24 each mounted on an inner surface of the overshot sleeve. Although the above construction is preferred for many applications, the slips 24 may be eliminated for some applications since a mechanically sound connection may be made between the expanded tubular 12 and the overshot sleeve 26. Also, in some applications the packing members 22 may be eliminated, and instead a seal between the casing 12 and the overshot sleeve 26 may be made by one or more circumferential bumps on the inner surface of the overshot sleeve, thereby providing metal-to-metal sealing engagement of the overshot sleeve and the expanded tubular.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An overshot tool for interconnecting and sealing between a lower tubular in a well and an upper tubular in the well, the overshot tool comprising:

a tubular expander sleeve supported in the well on the upper tubular;

an overshot sleeve supported in the well on the upper tubular, the overshot sleeve having an internal diameter greater than the outer diameter of the lower tubular for circumferentially surrounding a portion of the lower tubular;

a tool housing positioned in the well on a workstring and enclosing a plurality of axially movable stacked pistons for generating a cumulative axial force, each of the plurality of pistons axially movable in response to pressurized fluid transmitted downhole to the pistons on the workstring;

an anchor supported on the work string for engaging an inner surface of the lower tubular and axially fixing the tool in the well, the anchor movable from a run-in position to a set position; and the tool housing axially movable relative to a tool mandrel in response to the plurality of pistons, the tool housing movable to push the expander sleeve axially downward to radially expand a portion of the lower tubular, such that the overshot sleeve is connected to and sealed with the expanded lower tubular.

2. An overshot tool as defined in claim 1, further comprising:

a plurality of sealing members positioned on a radially inward surface of the overshot sleeve, such that the overshot sleeve and the plurality of sealing members are positioned radially outward of the lower tubular.

3. An overshot tool as defined in claim 1, wherein an internal diameter of the expander sleeve approximates an internal diameter of the lower tubular prior to expansion of a portion of the lower tubular.

4. An overshot tool as defined in claim 1, further comprising:

a threaded connector for interconnecting a lower end of the upper tubular and the expander sleeve.

5. An overshot tool as defined in claim 4, wherein the plurality of slips are positioned on the overshot sleeve axially above the plurality of seals.

6. An overshot tool as defined in claim 1, further comprising:

a plurality of circumferentially spaced slips positioned on the radially inner surface of the overshot sleeve for gripping engagement with the expanded lower tubular.

7. An overshot tool as defined in claim 1, further comprising:

a machining tool for machining an upper end of the lower tubular, such that a machined substantially conical surface at an upper end of the lower tubular engages a tapered end of the expander sleeve.

8. An overshot tool as defined in claim 1, wherein the anchor is positioned below the overshot sleeve.

9. An overshot tool for interconnecting and sealing between a lower tubular in a well and an upper tubular in the well, the overshot tool comprising:

a tubular expander sleeve supported in the well on the upper tubular;

an overshot sleeve supported in the well on the upper tubular, the overshot sleeve having an internal diameter greater than the outer diameter of the lower tubular for circumferentially surrounding a portion of the lower tubular;

a tool housing positioned in the well on a workstring;

a plurality of circumferentially spaced slips positioned on the radially inward surface of the overshot sleeve for gripping engagement with the expanded lower tubular;

an anchor supported on the work string for engaging an inner surface of the lower tubular and axially fixing the tool in the well, the anchor movable from a run-in to a set position;

a tool mandrel, the tool housing being axially movable relative to the tool mandrel when the anchor is set; and a plurality of pistons each connected to the mandrel for moving the anchor to the set position; and the tool housing axially movable relative to the tool mandrel in response to the plurality of pistons, the tool housing movable to push the expander sleeve axially downward to radially expand a portion of the lower tubular, such that the overshot sleeve is connected to and sealed with the expanded lower tubular.

10. An overshot tool as defined in claim 9, further comprising:

a plurality of sealing members positioned on a radially inward surface of the overshot sleeve, such that the overshot sleeve and the plurality of sealing members are positioned radially outward of the lower tubular.

11. An overshot tool as defined in claim 9, wherein an internal diameter of the expander sleeve approximates an internal diameter of a portion of the lower tubular prior to expansion of the lower tubular.

12. An overshot tool as defined in claim 9, further comprising:

a threaded connector for interconnecting a lower end of the upper tubular and the expander sleeve.

13. An overshot tool as defined in claim 9, wherein the anchor comprises:

a plurality of circumferentially spaced slips positioned on an interior of the overshot tool for gripping engagement with the lower tubular when expanded by the expander sleeve.

14. An overshot tool as defined in claim 9, wherein the anchor is positioned below the overshot sleeve.

15. A method of interconnecting and sealing between a lower tubular in a well and an upper tubular in the well, the method comprising:

supporting a tubular expander sleeve in the well on the upper tubular;

supporting an overshot sleeve in the well on the upper tubular, the overshot sleeve having an internal diameter greater than the outer diameter of the lower tubular for circumferentially surrounding a portion of the lower tubular;

positioning a tool housing in the well on a workstring and enclosing a plurality of axially movable stacked pistons for generating a cumulative axial force, each of the plurality of pistons axially movable in response to pressurized fluid transmitted downhole to the plurality of pistons on the workstring;

engaging an anchor with an inner surface of the lower tubular and axially fixing the position of the tool housing in the well, the anchor movable from a run-in to a set position in response to axial movement of the plurality of pistons;

axially moving the tool housing relative to the tool mandrel to set the anchor; and energizing the plurality of pistons to push the expander sleeve axially downward to radially expand a portion of the lower tubular, such that the overshot sleeve is connected to the expanded lower tubular.

16. A method as defined in claim 15, further comprising:

positioning a plurality of sealing members radially inward of the overshot tool, such that the overshot sleeve and the plurality of sealing members are positioned radially outward of the lower tubular.

17. A method as defined in claim 15, further comprising:

interconnecting a lower end of the upper tubular and the expander sleeve with a threaded connector.

18. A method as defined in claim 15, further comprising:

positioning a plurality of slips circumferentially about an interior of the overshot tool for gripping engagement with the lower tubular when expanded by the expander sleeve.

19. A method as defined in claim 15, further comprising:

positioning the plurality of slips on the overshot sleeve axially above the plurality of seals.

20. A method as defined in claim 15, further comprising:

machining an upper end of the lower tubular, such that a machined substantially conical surface of the lower tubular engages a tapered end of the expander sleeve.

* * * * *